US011727885B2

(12) United States Patent
Kim et al.

(10) Patent No.: US 11,727,885 B2
(45) Date of Patent: Aug. 15, 2023

(54) SCAN DRIVER AND DISPLAY DEVICE INCLUDING THE SAME

(71) Applicant: Samsung Display Co., Ltd., Yongin-si (KR)

(72) Inventors: Jonghee Kim, Yongin-si (KR); Bogyeong Kim, Yongin-si (KR); Takyoung Lee, Yongin-si (KR); Boyong Chung, Yongin-si (KR); Byungseok Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/847,732

(22) Filed: Jun. 23, 2022

(65) Prior Publication Data

US 2023/0186858 A1 Jun. 15, 2023

(30) Foreign Application Priority Data

Dec. 9, 2021 (KR) ..... 10-2021-0176114

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0819* (2013.01); *G09G 2300/0842* (2013.01); *G09G 2310/08* (2013.01)

(58) Field of Classification Search
CPC ..... G09G 3/3266; G09G 3/3233; G09G 2300/0819; G09G 2300/0842; G09G 2310/08
See application file for complete search history.

(56) References Cited

U.S. PATENT DOCUMENTS

| | | | | |
|---|---|---|---|---|
| 8,339,424 | B2 | 12/2012 | Jeong et al. | |
| 9,053,677 | B2 | 6/2015 | Park et al. | |
| 9,129,562 | B2 | 9/2015 | Jang et al. | |
| 11,017,724 | B2 | 5/2021 | Park | |
| 2007/0192659 | A1* | 8/2007 | Kang | G11C 19/184 714/726 |

(Continued)

FOREIGN PATENT DOCUMENTS

| | | | |
|---|---|---|---|
| KR | 10-0911982 | B1 | 8/2009 |
| KR | 10-1605433 | B1 | 3/2016 |

(Continued)

*Primary Examiner* — Jeff Piziali
(74) *Attorney, Agent, or Firm* — Lewis Roca Rothgerber Christie LLP

(57) ABSTRACT

A scan driver includes a plurality of stages, each of the plurality of stages including: a first controller to control voltage levels of a first control node and a second control node in response to a first start signal and a second start signal, and to output a first carry signal; a second controller to control voltage levels of a third control node and a fourth control node in response to the first start signal and the second start signal, and to output a second carry signal; and an output circuit including: a pull-up transistor having a gate connected to the first control node; and a pull-down transistor having a gate connected to the third control node. The output circuit is to output a scan signal based on an on voltage output through the pull-up transistor and an off voltage output through the pull-down transistor.

20 Claims, 7 Drawing Sheets

(56) References Cited

U.S. PATENT DOCUMENTS

| | | | | |
|---|---|---|---|---|
| 2010/0188316 | A1* | 7/2010 | Jang | H05B 45/60 345/76 |
| 2011/0080393 | A1* | 4/2011 | Kim | G09G 3/3266 327/144 |
| 2011/0273417 | A1* | 11/2011 | Shin | G09G 3/20 345/211 |
| 2015/0243238 | A1* | 8/2015 | Jung | G09G 3/3677 345/103 |
| 2016/0078811 | A1* | 3/2016 | Park | G09G 3/3233 345/78 |
| 2016/0247479 | A1* | 8/2016 | Cho | G09G 3/3677 |
| 2017/0076684 | A1* | 3/2017 | Kim | G09G 3/3677 |
| 2018/0337682 | A1* | 11/2018 | Takasugi | H03K 21/18 |
| 2019/0114964 | A1* | 4/2019 | Sung | G09G 3/2022 |
| 2020/0066211 | A1* | 2/2020 | Lee | G09G 3/3266 |
| 2020/0342808 | A1* | 10/2020 | Han | G09G 3/3266 |
| 2020/0349892 | A1* | 11/2020 | Park | G09G 3/3275 |
| 2021/0383769 | A1 | 12/2021 | Lee et al. | |

FOREIGN PATENT DOCUMENTS

| | | | |
|---|---|---|---|
| KR | 10-1868528 | B1 | 6/2018 |
| KR | 10-2018-0079102 | A | 7/2018 |
| KR | 10-1923718 | B1 | 11/2018 |
| KR | 10-1944465 | B1 | 2/2019 |
| KR | 10-2020-0128277 | A | 11/2020 |
| KR | 10-2021-0086516 | A | 7/2021 |

* cited by examiner

SCAN DRIVER AND DISPLAY DEVICE INCLUDING THE SAME

CROSS-REFERENCE TO RELATED APPLICATION

This application claims priority to and the benefit of Korean Patent Application No. 10-2021-0176114, filed on Dec. 9, 2021, in the Korean Intellectual Property Office, the entire disclosure of which is incorporated by reference herein.

BACKGROUND

1. Field

Aspects of one or more embodiments of the present disclosure relate to a scan driver, and a display device including the same.

2. Description of the Related Art

Display devices include a pixel unit including a plurality of pixels, a scan driver, a data driver, and a controller. The scan driver includes stages connected to scan lines, and the stages supply scan signals to the scan lines, respectively, in response to signals from the controller.

The above information disclosed in this Background section is for enhancement of understanding of the background of the present disclosure, and therefore, it may contain information that does not constitute prior art.

SUMMARY

One or more embodiments of the present disclosure relate to a scan driver that may output a scan signal stably, and a display device including the same.

However, the aspects and features of the present disclosure are not limited to the above aspects and features, and other aspects and features will be clearly understood by those having ordinary skill in the art. Additional aspects and features will be set forth, in part, in the description that follows, and in part, will be apparent from the description, or may be learned by practicing one or more of the presented embodiments of the present disclosure.

According to one or more embodiments of the present disclosure, a scan driver includes a plurality of stages, each of the plurality of stages including: a first controller configured to control voltage levels of a first control node and a second control node in response to a first start signal and a second start signal, and to output a first carry signal; a second controller configured to control voltage levels of a third control node and a fourth control node in response to the first start signal and the second start signal, and to output a second carry signal; and an output circuit including: a pull-up transistor having a gate connected to the first control node; and a pull-down transistor having a gate connected to the third control node. The output circuit is configured to output a scan signal based on an on voltage output through the pull-up transistor and an off voltage output through the pull-down transistor.

In an embodiment, each of the plurality of stages may include a plurality of transistors that are N-channel oxide thin film transistors.

In an embodiment, a circuit of the first controller and a circuit of the second controller may be symmetrical to each other relative to a node, the node being connected to a terminal configured to apply an off voltage to the first controller and the second controller.

In an embodiment, the pull-up transistor may be connected between a first voltage input terminal and a first output node, the first voltage input terminal being configured to receive a first voltage having an on voltage level, and the first output node being connected to a first output terminal configured to output the scan signal, and the pull-down transistor may be connected between a third voltage input terminal and the first output node, the third voltage input terminal being configured to receive a third voltage having an off voltage level.

In an embodiment, the plurality of stages may include a first stage and one or more rear-end stages, the first start signal applied to the first stage may be a first scan start signal, and the second start signal may be an inverted signal of the first start signal, and the first start signal and the second start signal applied to each of the rear-end stages that are subsequent to the first stage may be the first carry signal and the second carry signal that may be output by a corresponding previous stage.

In an embodiment, the first controller may include: a first transistor connected between a first voltage input terminal and the first control node, and having a gate connected to a first input terminal, the first voltage input terminal being configured to receive a first voltage having an on voltage level, and the first input terminal being configured to receive the first start signal; a second transistor connected between the first voltage input terminal and the second control node, and having a gate connected to a second input terminal configured to receive the second start signal; a third transistor connected between the first control node and a node, and having a gate connected to the second control node, the node being connected to a second voltage input terminal configured to receive a second voltage having an off voltage level; a fourth transistor connected between the second control node and the node, and having a gate connected to the first control node; a fifth transistor connected between a clock terminal and a second output node, and having a gate connected to the first control node, the clock terminal being configured to receive a clock signal, and the second output node being connected to a second output terminal configured to output the first carry signal; a sixth transistor connected between the second voltage input terminal and the second output node, and having a gate connected to the second control node; a first capacitor connected between the first control node and the second output node; and a second capacitor connected between the second control node and the second voltage input terminal.

In an embodiment, during a first period of a frame, in response to the second start signal being applied as an on voltage in at least a portion of the first period, the second transistor may be configured to set the second control node to an on voltage of the first voltage, and the third transistor may be configured to set the first control node to an off voltage of the second voltage; and during a second period after the first period, in response to the first start signal being applied as an on voltage in at least a portion of the second period, the first transistor may be configured to set the first control node to an on voltage of the first voltage, and the fourth transistor may be configured to set the second control node to an off voltage of the second voltage.

In an embodiment, the first controller may be configured to output the first carry signal based on the second voltage output through the sixth transistor during the first period, and based on the clock signal output through the fifth transistor during the second period.

In an embodiment, the clock signal output during the second period may include a plurality of pulses.

In an embodiment, the third transistor may include a pair of sub-transistors serially connected between the first control node and the node, and the first controller may further include a seventh transistor connected between the first voltage input terminal and an intermediate node between the pair of sub-transistors.

In an embodiment, the second controller may include: an eighth transistor connected between a first voltage input terminal and the third control node, and having a gate connected to a second input terminal, the first voltage input terminal being configured to receive a first voltage having an on voltage level, and the second input terminal being configured to receive the second start signal; a ninth transistor connected between the first voltage input terminal and the fourth control node, and having a gate connected to a first input terminal configured to receive the first start signal; a tenth transistor connected between the third control node and a node, and having a gate connected to the fourth control node, the node being connected to a second voltage input terminal configured to receive a second voltage having an off voltage level; an eleventh transistor connected between the fourth control node and the node, and having a gate connected to the third control node; a twelfth transistor connected between a clock terminal and a third output node, and having a gate connected to the third control node, the clock terminal being configured to receive a clock signal, and the third output node being connected to a third output terminal configured to output the second carry signal; a thirteenth transistor connected between the second voltage input terminal and the third output node, and having a gate connected to the fourth control node; a third capacitor connected between the third control node and the third output node; and a fourth capacitor connected between the fourth control node and the second voltage input terminal.

In an embodiment, during a first period of a frame, in response to the second start signal being applied as an on voltage in at least a portion of the first period, the eighth transistor may be configured to set the third control node to an on voltage of the first voltage, and the eleventh transistor may be configured to set the fourth control node to an off voltage of the second voltage; and during a second period after the first period, in response to the first start signal being applied as an on voltage in at least a portion of the second period, the ninth transistor may be configured to set the fourth control node to an on voltage of the first voltage, and the tenth transistor may be configured to set the third control node to an off voltage of the second voltage.

In an embodiment, the second controller may be configured to output the second carry signal based on the clock signal output through the twelfth transistor during the first period, and based on the second voltage output through the thirteenth transistor during the second period.

In an embodiment, the clock signal output during the first period may include a plurality of pulses.

In an embodiment, the tenth transistor may include a pair of sub-transistors serially connected between the third control node and the node, and the second controller may further include a fourteenth transistor connected between the first voltage input terminal and an intermediate node between the pair of sub-transistors.

According to one or more embodiments of the present disclosure, a display device includes: a pixel area including a plurality of pixels, the plurality of pixels being connected to scan lines and data lines; and a scan driver configured to output scan signals to the scan lines. The scan driver includes a plurality of stages, each of the plurality of stages including: a first controller configured to control voltage levels of a first control node and a second control node in response to a first start signal and a second start signal, and to output a first carry signal; a second controller configured to control voltage levels of a third control node and a fourth control node in response to the first start signal and the second start signal, and to output a second carry signal; and an output circuit including: a pull-up transistor having a gate connected to the first control node; and a pull-down transistor having a gate connected to the third control node. The output circuit is configured to output a scan signal based on an on voltage output through the pull-up transistor and an off voltage output through the pull-down transistor.

In an embodiment, each of the pixels may include a pixel circuit including a plurality of transistors that are N-channel oxide thin film transistors, and each of the stages may include a plurality of transistors that are N-channel oxide thin film transistors.

In an embodiment, a circuit of the first controller and a circuit of the second controller may be symmetrical to each other relative to a node, the node being connected to a terminal configured to apply an off voltage to the first controller and the second controller.

In an embodiment, the pull-up transistor may be connected between a first voltage input terminal and a first output node, the first voltage input terminal being configured to receive a first voltage having an on voltage level, and the first output node being connected to a first output terminal configured to output the scan signal, and the pull-down transistor may be connected between a third voltage input terminal and the first output node, the third voltage input terminal being configured to receive a third voltage having an off voltage level.

In an embodiment, the plurality of stages may include a first stage and one or more rear-end stages, the first start signal applied to the first stage may be a first scan start signal, and the second start signal may be an inverted signal of the first start signal, and the first start signal and the second start signal applied to each of the rear-end stages that are subsequent to the first stage may be the first carry signal and the second carry signal that may be output by a corresponding previous stage.

BRIEF DESCRIPTION OF THE DRAWINGS

The above and other aspects and features of the present disclosure will be more clearly understood from the following detailed description of the illustrative, non-limiting embodiments with reference to the accompanying drawings, in which.

DETAILED DESCRIPTION

Figure 1:
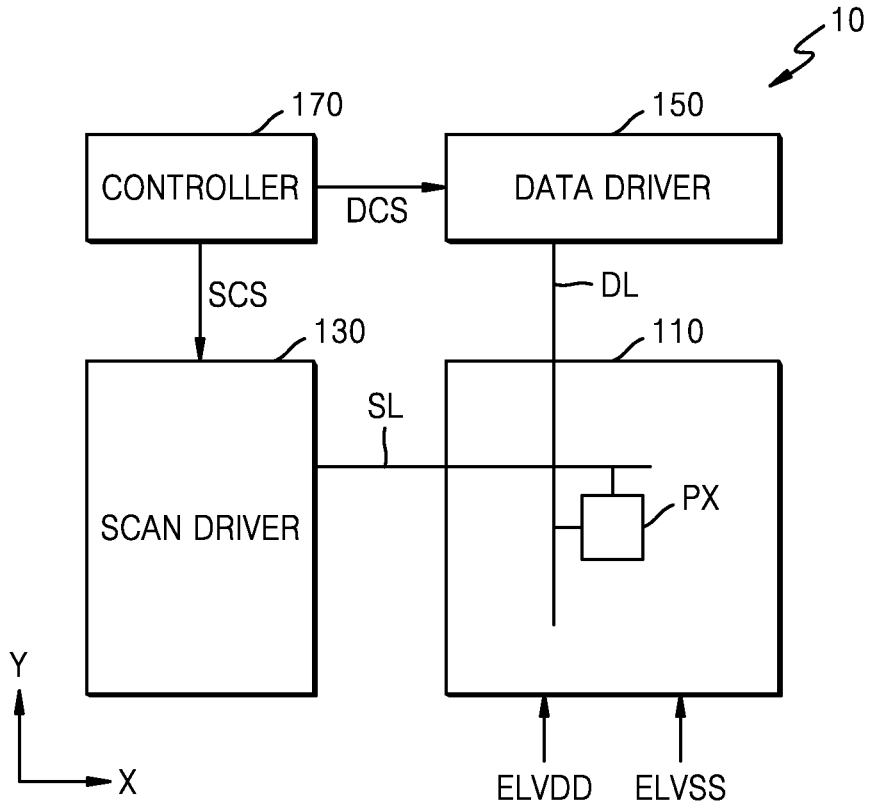
FIG. 1 is a view schematically illustrating a display device according to an embodiment.

Hereinafter, embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, redundant description thereof may not be repeated.

When a certain embodiment may be implemented differently, a specific process order may be different from the described order. For example, two consecutively described processes may be performed at the same or substantially at the same time, or may be performed in an order opposite to the described order.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

In the figures, the x-axis, the y-axis, and the z-axis are not limited to three axes of the rectangular coordinate system, and may be interpreted in a broader sense. For example, the x-axis, the y-axis, and the z-axis may be perpendicular to or substantially perpendicular to one another, or may represent different directions from each other that are not perpendicular to one another.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. Similarly, when a layer, an area, or an element is referred to as being "electrically connected" to another layer, area, or element, it may be directly electrically connected to the other layer, area, or element, and/or may be indirectly electrically connected with one or more intervening layers, areas, or elements therebetween. In addition, it will also be understood that when an element or layer is referred to as being "between" two elements or layers, it can be the only element or layer between the two elements or layers, or one or more intervening elements or layers may also be present.

For example, when X and Y are described as being connected to each other, there may be cases where X and Y are electrically connected to each other, X and Y are functionally connected to each other, and/or X and Y are directly connected to each other. Here, X and Y may be an object (e.g., an apparatus, a device, a circuit, a wiring, an electrode, a terminal, a conductive layer, a layer, or the like). Thus, the present disclosure is not limited to a certain connection relationship, for example, a connection relationship indicated in the drawings or described in a detailed description thereof, and may include a connection relationship other than a connection relationship indicated in the drawings or described in the detailed description thereof.

When X and Y are described as being electrically connected to each other, for example, there may be a case where one or more elements (e.g., a switch, a transistor, a capacitive element, an inductor, a resistive element, a diode, and/or the like) for enabling the electrical connection of X and Y are connected between X and Y.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, the expression "A and/or B" denotes A, B, or A and B. Expressions such as "at least one of," when preceding a list of elements, modify the entire list of elements and do not modify the individual elements of the list. For example, the expression "at least one of a, b, or c," "at least one of a, b, and c," and "at least one selected from the group consisting of a, b, and c" indicates only a, only b, only c, both a and b, both a and c, both b and c, all of a, b, and c, or variations thereof.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively.

As used herein, the term "on" used in association with a state of a device may refer to an activated state of the device, and the term "off" used in association with the state of a device may refer to an inactive state of the device. As used herein, the term "on" used in association with a signal received by a device may refer to a signal for activating the device, and the term "off" used in association with a signal received by a device may refer to a signal for deactivating the device. A device may be activated by a high-level voltage or low-level voltage. For example, a P-type transistor may be activated (e.g., turned on) by the low-level voltage, and an N-type transistor may be activated (e.g., turned on) by the high-level voltage. Thus, it is to be understood that the "on" voltage for the P-type transistor and the "on" voltage for the N-type transistor are at opposite (e.g., low versus high) voltage levels from each other. Hereinafter, a voltage for turning on a transistor may be referred to as an on voltage, and a voltage for turning off the transistor may be referred to as an off voltage.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a view schematically illustrating a display device according to an embodiment.

A display device 10 according to an embodiment may be, for example, an organic light emitting display device, an inorganic light emitting display device, an inorganic electroluminent (EL) display device, or a quantum dot light emitting display device.

Referring to FIG. 1, the display device 10 according to an embodiment may include a pixel unit (e.g., a pixel area, a pixel layer, or a pixel panel) 110, a scan driver 130, a data driver 150, and a controller 170.

A plurality of pixels PX, and signal lines for applying an electrical signal to the plurality of pixels PX, may be arranged at (e.g., in or on) the pixel unit 110. The pixel unit 110 may be a display area in which an image is displayed.

The plurality of pixels PX may be repeatedly arranged along a first direction (e.g., an x-direction, a row direction, and the like), and along a second direction (e.g., a y-direction, a column direction, and the like). The plurality of pixels PX may be arranged in various suitable shapes, such as a stripe arrangement, an RGBG arrangement (e.g., a PENTILE® arrangement, PENTILE® being a duly registered trademark of Samsung Display Co., Ltd.), a mosaic arrangement, and the like, so as to implement an image. Each of the plurality of pixels PX may include an organic light emitting diode as a display element, and the organic light emitting diode may be connected to a pixel circuit. The pixel circuit may include a plurality of transistors, and at least one capacitor. In an embodiment, the plurality of transistors included in the pixel circuit may be N-type thin film transistors. The N-type thin film transistors may be oxide thin film transistors in which an active pattern (e.g., a semiconductor layer) includes an amorphous oxide or crystalline oxide. The oxide thin film transistor may have excellent off current characteristics.

The signal lines for applying electrical signals to the plurality of pixels PX may include a plurality of scan lines SL extending in the first direction, and a plurality of data lines DL extending in the second direction. The plurality of scan lines SL may be spaced apart from each other in the second direction, and may transmit a scan signal to the pixels PX. The plurality of data lines DL may be spaced apart from each other in the first direction, and may transmit a data signal to the pixels PX. Each of the plurality of pixels PX may be connected to at least one corresponding scan line from among the plurality of scan lines SL, and a corresponding data line from among the plurality of data lines DL. In FIG. 1, for convenience of illustration, one scan line SL is shown connected to the pixels PX. However, each pixel PX may be connected to a plurality of scan lines according to a number of transistors that constitutes the pixel circuit.

The scan driver 130 may be connected to the plurality of scan lines SL, and may generate a scan signal in response to a control signal SCS from the controller 170 to sequentially supply the scan signal to the plurality of scan lines SL. The scan line SL may be connected to a gate of a transistor included in the pixel circuit, and the scan signal may be transmitted to the gate of the transistor. The scan signal may be a square wave signal in which an on voltage for turning on the transistor and an off voltage for turning off the transistor are repeated (e.g., are pulsed). In an embodiment, the on voltage may be a high-level voltage (hereinafter, referred to as a "high voltage").

The data driver 150 may be connected to the plurality of data lines DL, and may supply data signals to the data lines DL in response to a control signal DCS from the controller 170. The data signal supplied to the data line DL may be supplied to a pixel PX connected thereto to which the scan signal is supplied. In other words, the data driver 150 may supply a data signal to the data line DL to be synchronized or substantially synchronized with the scan signal.

The controller 170 may generate a scan control signal SCS and a data control signal DCS based on signals input from the outside. The controller 170 may supply the scan control signal SCS to the scan driver 130, and may supply the data control signal DCS to the data driver 150.

Figure 2:
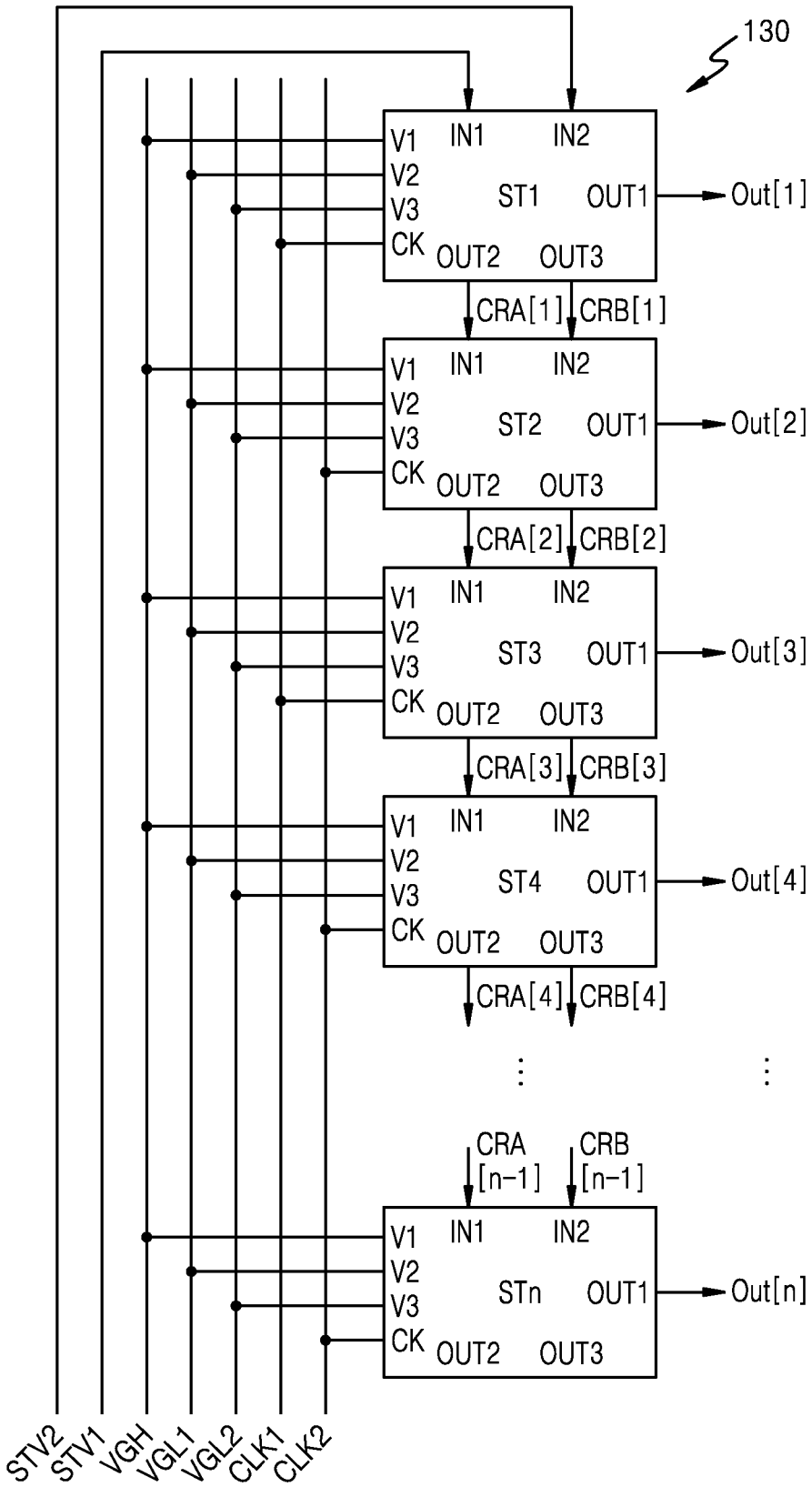
FIG. 2 is a view schematically illustrating a scan driver according to an embodiment.
Figure 3:
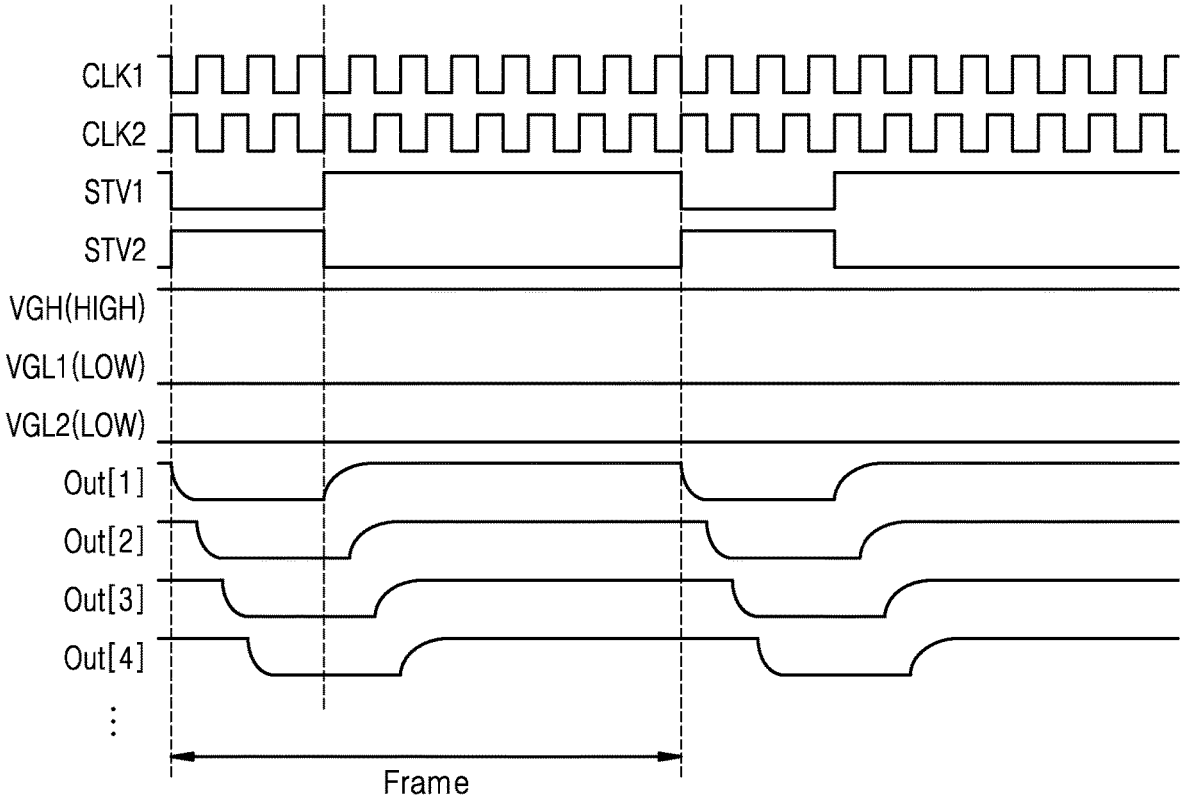
FIG. 3 is a view illustrating waveforms of some input/output signals applied to the scan driver of FIG. 2.

FIG. 2 is a view schematically illustrating a scan driver according to an embodiment. FIG. 3 is a view illustrating waveforms of some input/output signals applied to the scan driver of FIG. 2.

Referring to FIG. 2, the scan driver 130 may include a plurality of stages ST including first through n-th stages ST1 through STn, where n is a natural number. Each of the first through n-th stages ST1 through STn may correspond to a pixel row (e.g., a pixel line) provided in the pixel unit 110. The number of stages of the scan driver 130 may be variously modified according to the number of pixel rows.

Each of the plurality of first through n-th stages ST1 through STn may include a first input terminal IN1, a second input terminal IN2, a clock terminal CK, a first voltage input terminal V1, a second voltage input terminal V2, a third voltage input terminal V3, a first output terminal OUT1, a second output terminal OUT2, and a third output terminal OUT3.

The first input terminal IN1 may receive a first scan start signal STV1, or a previous first carry signal CRA, as a first start signal. In an embodiment, the first scan start signal STV1 may be applied to the first input terminal IN1 of the first stage ST1, and a first carry signal CRA output by a corresponding previous stage may be applied to the first input terminal IN1 of each of the second through n-th stages ST2 through STn, which are rear-end stages of (e.g., subsequent stages with respect to) the first stage ST1.

The second input terminal IN2 may receive a second scan start signal STV2, or a previous second carry signal CRB, as a second start signal. In an embodiment, the second scan start signal STV2 may be applied to the second input terminal IN2 of the first stage ST1, and a second carry signal CRB output by a corresponding previous stage may be applied to the second input terminal IN2 of each of the second through n-th stages ST2 through STn, which are rear-end stages of (e.g., subsequent stages with respect to) the first stage ST1.

For example, the first stage ST1 may start driving in response to the first scan start signal STV1 and the second scan start signal STV2, and may generate and output a first output signal Out[1]. A first carry signal CRA[n−1] and a second carry signal CRB[n−1] output by an (n−1)-th stage may be input to the first input terminal IN1 and the second input terminal IN2, respectively, of the n-th stage STn, and the n-th stage STn may generate and output an n-th output signal Out[n].

As shown in FIG. 3, the first scan start signal STV1 and the second scan start signal STV2 may be signals in which a low-level voltage (hereinafter, referred to as a "low voltage") and a high-level voltage alternate with each other. The second scan start signal STV2 may be an inverted signal of the first scan start signal STV1. The first scan start signal STV1 and the second scan start signal STV2 may have one low voltage period and one high voltage period during one frame. Here, a frame (e.g., a frame period) may be a period in which one frame image is displayed.

The clock terminal CK may receive a first clock signal CLK1 or a second clock signal CLK2. The first clock signal CLK1 and the second clock signal CLK2 may be alternately applied to the first through n-th stages ST1 through STn. For example, the first clock signal CLK1 may be applied to the clock terminal CK of an odd-numbered stage, and the second clock signal CLK2 may be applied to the clock terminal CK of an even-numbered stage.

As shown in FIG. 3, the first clock signal CLK1 and the second clock signal CLK2 may be square wave signals in which a high voltage and a low voltage are repeated (e.g., are pulsed). The first clock signal CLK1 and the second clock signal CLK2 may be signals which have the same or substantially the same waveform as each other, but with shifted phases from each other. For example, the second clock signal CLK2 may have the same or substantially the same waveform as that of the first clock signal CLK1, but may be an inverted signal having a 180-degree phase difference (e.g., a ½ period phase difference) from that of the first clock signal CLK1. In other words, pulses (e.g., high voltage periods) of the first clock signal CLK1 and the second clock signal CLK2 may not overlap with each other.

The first voltage input terminal V1 may receive a first voltage VGH, which may be a high voltage. The second voltage input terminal V2 may receive a second voltage VGL1, which may be a low voltage. The third voltage input terminal V3 may receive a third voltage VGL2, which may be a low voltage. The third voltage VGL2 may be a voltage that is lower than that of the second voltage VGL1. The first voltage VGH, the second voltage VGL1, and the third voltage VGL2 may be global signals that are supplied from the controller 170 shown in FIG. 1, and/or a power supply unit (e.g., a power supply, a power supply circuit, or a power supply device) or the like.

The first output terminal OUT1 may output an output signal Out. The output signal Out may be supplied to a pixel through a corresponding scan line. The second output terminal OUT2 may output the first carry signal CRA. The third output terminal OUT3 may output the second carry signal CRB.

The plurality of first through n-th stages ST1 through STn may output first through n-th output signals Out[1], Out[2], Out[3], Out[4], . . . , and Out[n], in response to the first start signal and the second start signal. Here, an output signal Out output by each of the first through n-th stages ST1 through STn may be a scan signal. The first through n-th output signals Out[1], Out[2], Out[3], Out[4], . . . , and Out[n] may be shifted by a phase difference between the first clock signal CLK1 and the second clock signal CLK2, and may be sequentially output to the scan lines SL.

Each of the first carry signals CRA[1], CRA[2], CRA[3], CRA[4], . . . , and CRA[n−1], which are output from the second output terminals OUT2 of the first through (n−1)-th stages ST1 through ST(n−1), may be applied to the first input terminal IN1 of a corresponding rear-end stage (e.g., a corresponding subsequent stage). Each of the second carry signals CRB[1], CRB[2], CRB[3], CRB[4], . . . , and CRB[n−1], which are output from the third output terminals OUT3 of the first through (n−1)-th stages ST1 through ST(n−1), may be applied to the second input terminal IN2 of the corresponding rear-end stage. In an embodiment, the first carry signal and the second carry signal output from the second output terminal OUT2 and the third output terminal OUT3, respectively, of the n-th stage STn may be applied to a rear-end dummy stage.

Figure 4:
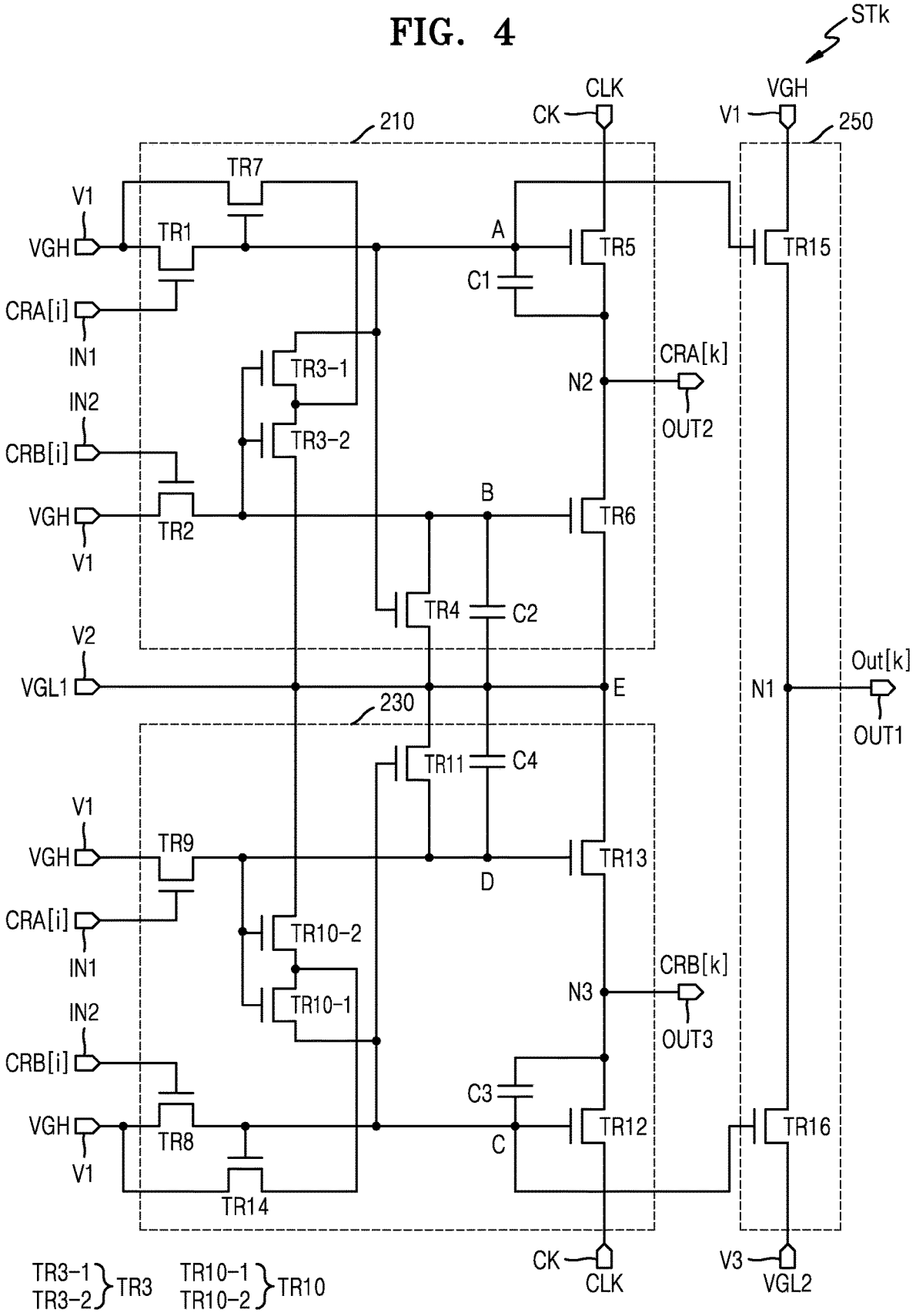
FIG. 4 is a circuit diagram illustrating a stage included in the scan driver of FIG. 2, according to an embodiment.
Figure 5:
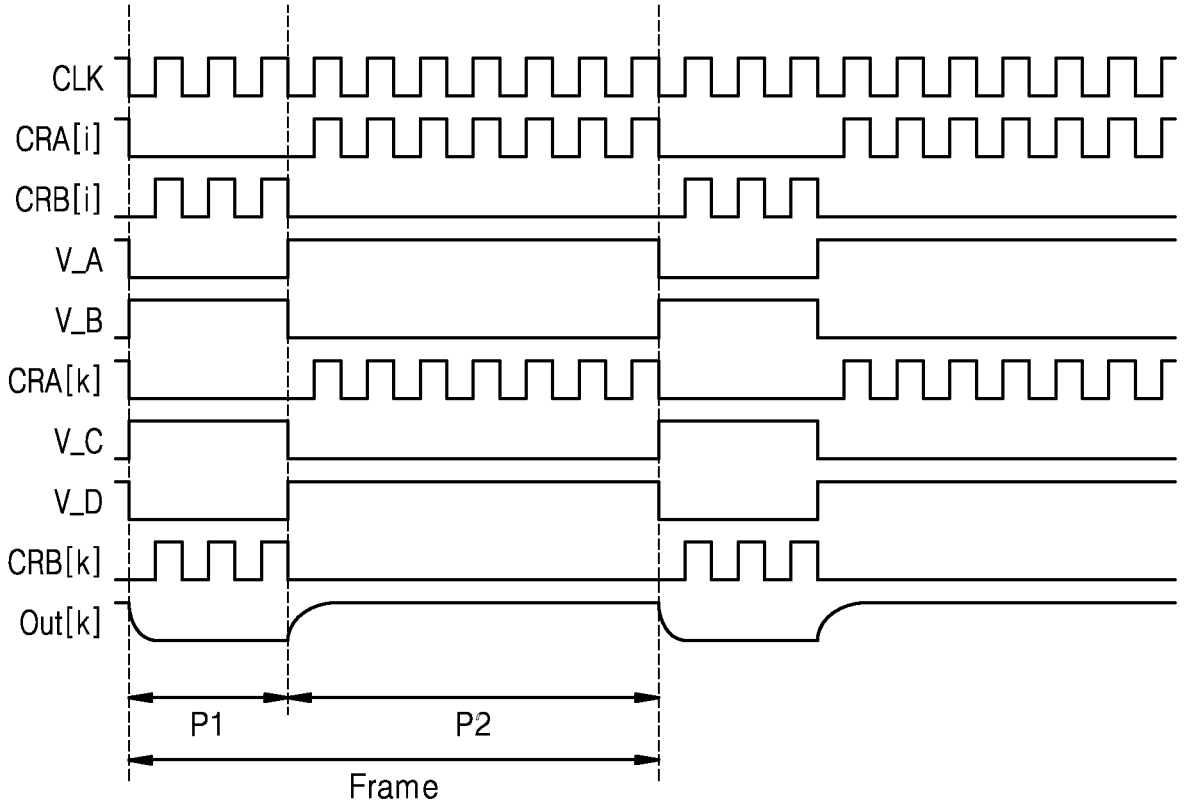
FIG. 5 is a waveform diagram illustrating an example of an operation of the stage of FIG. 4.

FIG. 4 is a circuit diagram illustrating a stage included in the scan driver of FIG. 2, according to an embodiment. FIG. 5 is a waveform diagram illustrating an example of an operation of the stage of FIG. 4.

Each of the first through n-th stages ST1 through STn may include a plurality of nodes. Hereinafter, some of the plurality of nodes are referred to as first through third output nodes N1 through N3, and first through fourth control nodes A, B, C, and D.

Hereinafter, a k-th stage STk at which a k-th output signal Out[k] is output to a k-th row of the pixel unit 110 will be described in more detail as an example. Each of the first through n-th stages ST1 through STn may have the same or substantially the same circuit structure as that of the k-th stage STk shown in FIG. 4, and thus, redundant description thereof may not be repeated. In an embodiment, a plurality of transistors included in a circuit of each of the first through n-th stages ST1 through STn may be N-type thin film transistors. The N-type thin film transistors may be oxide thin film transistors.

Referring to FIG. 4, the k-th stage STk (where k is a natural number) may include a first controller 210, a second controller 230, and an output unit (e.g., an output circuit) 250.

A circuit structure of the first controller 210 and a circuit structure of the second controller 230 may be symmetrical or substantially symmetrical to each other (e.g., in an up and down direction in FIG. 4) based on (e.g., relative to) a node E. Input signals of each of the first controller 210 and the second controller 230 may include a first start signal, a second start signal, a clock signal CLK, a first voltage VGH, a second voltage VGL1, and a third voltage VGL2. In the first stage ST1, the first start signal and the second start signal may be the first scan start signal STV1 and the second scan start signal STV2, respectively. In the second through n-th stages ST2 through STn, the first start signal and the second start signal may be a first carry signal CRA[i] and a second carry signal CRB[i], respectively, which are output from a corresponding previous stage.

The first controller 210 may control voltages of the first control node A and the second control node B based on the input signals. The first controller 210 may generate a first carry signal CRA[k] based on the clock signal CLK or the second voltage VGL1, according to the voltages of the first control node A and the second control node B, and may output the first carry signal CRA[k] to the second output terminal OUT2 connected to the second output node N2.

The first controller 210 may include a first transistor TR1, a second transistor TR2, a third transistor TR3, a fourth transistor TR4, a fifth transistor TR5, a sixth transistor TR6, a first capacitor C1, and a second capacitor C2. The first controller 210 may further include a seventh transistor TR7.

The first transistor TR1 may be connected between the first voltage input terminal V1 and the first control node A. A gate of the first transistor TR1 may be connected to the first input terminal IN1.

The second transistor TR2 may be connected between the first voltage input terminal V1 and the second control node B. A gate of the second transistor TR2 may be connected to the second input terminal IN2.

The third transistor TR3 may be connected between the first control node A and the node E. The third transistor TR3 may include a pair of sub-transistors TR3-1 and TR3-2 that are serially connected between the first control node A and the node E. In an embodiment, the third transistor TR3 may include a (3-1)-th transistor TR3-1 and a (3-2)-th transistor TR3-2. Gates of the (3-1)-th transistor TR3-1 and the (3-2)-th transistor TR3-2 may be connected to the second control node B.

The fourth transistor TR4 may be connected between the second control node B and the node E. A gate of the fourth transistor TR4 may be connected to the first control node A.

The fifth transistor TR5 may be connected between the clock terminal CK and the second output node N2. A gate of the fifth transistor TR5 may be connected to the first control node A. The fifth transistor TR5 may be turned on or turned off according to the voltage of the first control node A. When the first control node A has a high voltage, the fifth transistor TR5 may be turned on, so that the clock signal CLK may be output to the second output terminal OUT2 as the first carry signal CRA[k] through the fifth transistor TR5.

The sixth transistor TR6 may be connected between the node E and the second output node N2. A gate of the sixth transistor TR6 may be connected to the second control node B. The sixth transistor TR6 may be turned on or turned off according to the voltage of the second control node B. When the second control node B has a high voltage, the sixth transistor TR6 may be turned on, so that the second voltage VGL1 may be output to the second output terminal OUT2 as the first carry signal CRA[k] through the sixth transistor TR6.

The seventh transistor TR7 may be connected between the first voltage input terminal V1 and an intermediate node (e.g., a common electrode) between the (3-1)-th transistor TR3-1 and the (3-2)-th transistor TR3-2. A gate of the seventh transistor TR7 may be connected to the first control node A. When the seventh transistor TR7 is turned on, a first voltage VGH may be applied to the intermediate node of the (3-1)-th transistor TR3-1 and the (3-2)-th transistor TR3-2, so that current leakage of the first control node A through the third transistor TR3 may be minimized or reduced.

The first capacitor C1 may be connected between the first control node A and the second output node N2. When the fifth transistor TR5 is turned on, the voltage of the first control node A may be bootstrapped by the first capacitor C1. The second capacitor C2 may be connected between the second control node B and the node E.

The second controller 230 may control voltages of the third control node C and the fourth control node D based on the input signals. The second controller 230 may generate a second carry signal CRB[k] based on the clock signal CLK or the second voltage VGL1, according to the voltages of the third control node C and the fourth control node D, and may output the second carry signal CRB[k] to the third output terminal OUT3 connected to the third output node N3.

The second controller 230 may include an eighth transistor TR8, a ninth transistor TR9, a tenth transistor TR10, an eleventh transistor TR11, a twelfth transistor TR12, a thirteenth transistor TR13, a third capacitor C3, and a fourth capacitor C4. The second controller 230 may further include a fourteenth transistor TR14.

The eighth transistor TR8 may be connected between the first voltage input terminal V1 and the third control node C. A gate of the eighth transistor TR8 may be connected to the second input terminal IN2.

The ninth transistor TR9 may be connected between the first voltage input terminal V1 and the fourth control node D. A gate of the ninth transistor TR9 may be connected to the first input terminal IN1.

The tenth transistor TR10 may be connected between the third control node C and the node E. The tenth transistor TR10 may include a pair of sub-transistors TR10-1 and TR10-2 that are serially connected between the third control node C and the node E. In an embodiment, the tenth transistor TR10 may include a (10-1)-th transistor TR10-1 and a (10-2)-th transistor TR10-2. Gates of the (10-1)-th transistor TR10-1 and the (10-2)-th transistor TR10-2 may be connected to the fourth control node D.

The eleventh transistor TR11 may be connected between the fourth control node D and the node E. A gate of the eleventh transistor TR11 may be connected to the third control node C.

The twelfth transistor TR12 may be connected between the clock terminal CK and the third output node N3. A gate of the twelfth transistor TR12 may be connected to the third control node C. The twelfth transistor TR12 may be turned on or turned off according to the voltage of the third control node C. When the third control node C has a high voltage, the twelfth transistor TR12 may be turned on, so that the clock signal CLK may be output to the third output terminal OUT3 as the second carry signal CRB[k] through the twelfth transistor TR12.

The thirteenth transistor TR13 may be connected between the node E and the third output node N3. A gate of the thirteenth transistor TR13 may be connected to the fourth control node D. The thirteenth transistor TR13 may be turned on or turned off according to the voltage of the fourth control node D. When the fourth control node D has a high voltage, the thirteenth transistor TR13 may be turned on, so that the second voltage VGL1 may be output to the third output terminal OUT3 as the second carry signal CRB[k] through the thirteenth transistor TR13.

The fourteenth transistor TR14 may be connected between the first voltage input terminal V1 and an intermediate node (e.g., a common electrode) between the (10-1)-th transistor TR10-1 and the (10-2)-th transistor TR10-2. A gate of the fourteenth transistor TR14 may be connected to the third control node C. When the fourteenth transistor TR14 is turned on, a first voltage VGH may be applied to the intermediate node of the (10-1)-th transistor TR10-1 and the (10-2)-th transistor TR10-2, so that current leakage of the third control node C through the tenth transistor TR10 may be minimized or reduced.

The third capacitor C3 may be connected between the third control node C and the third output node N3. When the twelfth transistor TR12 is turned on, the voltage of the third control node C may be bootstrapped by the third capacitor C3. The fourth capacitor C4 may be connected between the fourth control node D and the node E.

The output unit 250 may output a first voltage VGH or a third voltage VGL2 to the first output terminal OUT1 connected to the first output node N1 according to voltages of the first control node A and the third control node C. The first control node A and the third control node C may alternately have an on voltage in frame units.

The output unit 250 may include a fifteenth transistor TR15 as a pull-up transistor for outputting a high voltage, and a sixteenth transistor TR16 as a pull-down transistor for outputting a low voltage. The fifteenth transistor TR15 may be turned on or tuned off by control of the first controller 210. The sixteenth transistor TR16 may be turned on or tuned off by control of the second controller 230. The fifteenth transistor TR15 and the sixteenth transistor TR16 may be alternately turned on in frame units.

The fifteenth transistor TR15 may be connected between the first voltage input terminal V1 and the first output node N1. A gate of the fifteenth transistor TR15 may be connected to the first control node A. The fifteenth transistor TR15 may be turned on or turned off according to the voltage of the first control node A. When the first control node A has a high voltage, the fifteenth transistor TR15 may be turned on, so that a first voltage VGH as a high voltage may be output to the first output terminal OUT1 as a k-th output signal Out[k] through the fifteenth transistor TR15.

The sixteenth transistor TR16 may be connected between the third voltage input terminal V3 and the first output node N1. A gate of the sixteenth transistor TR16 may be connected to the third control node C. The sixteenth transistor TR16 may be turned on or turned off according to the voltage of the third control node C. When the third control node C has a high voltage, the sixteenth transistor TR16 may be turned on, and a third voltage VGL2 as a low voltage may be output to the first output terminal OUT1 as a k-th output signal Out[k] through the sixteenth transistor TR16.

A previous first carry signal CRA[i] and a previous second carry signal CRB[i], which are start signals, the clock signal CLK, node voltages of first through fourth control nodes A, B, C, and D, the first carry signal CRA[k]), the second carry signal CRB[k], and the output signal Out[k] are shown in FIG. 5.

The previous first carry signal CRA[i] and the previous second carry signal CRB[i] may be the first carry signal and the second carry signal, which are output from a front-end stage, and the front-end stage may be at least one previous stage. For example, as shown in FIGS. 4 and 5, the previous first carry signal CRA[i] and the previous second carry signal CRB[i] may be signals output by one previous front-end stage.

The clock signal CLK may be the first clock signal CLK1 or the second clock signal CLK2.

A high voltage may refer to an on voltage, and a low voltage may refer to an off voltage. Hereinafter, an operation of a stage in one frame will be described in more detail with reference to FIG. 5. One frame may include a first period P1 at which a scan signal having an off voltage is output, and a second period P2 at which a scan signal having an on voltage is output.

In the first period P1, the first control node A and the fourth control node D may have an off voltage, and the second control node B and the third control node C may have an on voltage.

In the first period P1, the first carry signal CRA[i] of a low voltage may be applied to the first input terminal IN1, and the second carry signal CRB[i] having a waveform that is the same or substantially the same as that of the clock signal CLK may be applied to the second input terminal IN2. Like the waveform of the clock signal CLK, the waveform of the second carry signal CRB[i] applied in the first period P1 may include a plurality of pulses, and may be applied as a high voltage in at least a portion of the first period P1.

According to the second carry signal CRB[i] in which a high voltage and a low voltage are repeated, the second transistor TR2 of the first controller 210 and the eighth transistor TR8 of the second controller 230 may be repeatedly turned on and turned off. When the second transistor TR2 and the eighth transistor TR8 are turned on by the high voltage of the second carry signal CRB[i], the first voltage VGH may be transmitted to the second control node B and the third control node C, and the second control node B and the third control node C may have (e.g., may be set to) a high voltage. When the second transistor TR2 and the eighth transistor TR8 are turned off by the low voltage of the second carry signal CRB[i], the second control node B and the third control node C may be maintained or substantially maintained at the high voltage.

The fourteenth transistor TR14 having the gate connected to the third control node C may be turned on, so that a high voltage may be transmitted to the intermediate node of the tenth transistor TR10.

The first transistor TR1 of the first controller 210 and the ninth transistor TR9 of the second controller 230 may be turned off by the first carry signal CRA[i] of the low voltage. The third transistor TR3 and the eleventh transistor TR11 having the gates connected to the second control node B and the third control node C, respectively, which have a high voltage, may be turned on. Thus, the second voltage VGL1 may be transmitted to the first control node A through the third transistor TR3, and the second voltage VGL1 may be transmitted to the fourth control node D through the eleventh transistor TR11, so that the first control node A and the fourth control node D may have (e.g., may be set to) a low voltage. The fourth transistor TR4 having the gate connected to the first control node A and the tenth transistor T10 having the gate connected to the fourth control node D may be turned off.

The second control node B and the third control node C may have a high voltage. Accordingly, the sixteenth transistor TR16 of the output unit 250 having the gate connected to the third control node C, the sixth transistor TR6 of the first controller 210 having the gate connected to the second control node B, and the twelfth transistor TR12 of the second controller 230 having the gate connected to the third control node C may be turned on. A third voltage VGL2 may be transmitted to the first output node N1 through the sixteenth transistor TR16, a second voltage VGL1 may be transmitted to the second output node N2 through the sixth transistor TR6, and a clock signal CLK may be transmitted to the third output node N3 through the twelfth transistor TR12. Thus, the output unit 250 may output a k-th output signal Out[k] having a low voltage through the first output terminal OUT1, the first controller 210 may output a first carry signal CRA[k] having a low voltage through the second output terminal OUT2, and the second controller 230 may output a second carry signal CRB[k] following a waveform (e.g., having a waveform that is the same or substantially the same as that) of the clock signal CLK through the third output terminal OUT3.

In the first period P1, a transistor of a pixel circuit, to which the k-th output signal Out[k] of the low voltage is applied to a gate thereof, may be turned off.

In the second period P2, the first control node A and the fourth control node D may have an on-voltage, and the second control node B and the third control node C may have an off-voltage.

In the second period P2, a first carry signal CRA[i] having a waveform that is the same or substantially the same as that of the clock signal CLK may be applied to the first input terminal IN1, and a second carry signal CRB[i] having the low voltage may be applied to the second input terminal IN2. Like the waveform of the clock signal CLK, the waveform of the first carry signal CRA[i] applied in the second period P2 may include a plurality of pulses, and may be applied as a high voltage in at least a portion of the second period P2.

According to the first carry signal CRA[i] in which a high voltage and a low voltage are repeated, the first transistor TR1 of the first controller 210 and the ninth transistor TR9 of the second controller 230 may be repeatedly turned on and turned off. When the first transistor TR1 and the ninth transistor TR9 are turned on by the high voltage of the first carry signal CRA[i], the first voltage VGH may be transmitted to the first control node A and the fourth control node D, and the first control node A and the fourth control node D may have (e.g., may be set to) a high voltage. When the first transistor TR1 and the ninth transistor TR9 are turned off by the low voltage of the first carry signal CRA[i], the first control node A and the fourth control node D may be maintained or substantially maintained at the high voltage. The seventh transistor TR7 having the gate connected to the first control node A may be turned on, so that a high voltage may be transmitted to the intermediate node of the third transistor TR3.

The second transistor TR2 of the first controller 210 and the eighth transistor TR8 of the second controller 230 may be turned off by the second carry signal CRB[i] of the low voltage. The first control node A and the fourth control node D may have (e.g., may be set to) a high voltage, and the fourth transistor TR4 having the gate connected to the first control node A and the tenth transistor TR10 having the gate connected to the fourth control node D may be turned on. Thus, the second voltage VGL1 may be transmitted to the second control node B through the fourth transistor TR4, and the second voltage VGL1 may be transmitted to the third control node C through the tenth transistor TR10, so that the second control node B and the third control node C may have (e.g., may be set to) a low voltage. The third transistor TR3 having the gate connected to the second control node B and the eleventh transistor T11 having the gate connected to the third control node C may be turned off.

The fifteenth transistor TR15 of the output unit 150 having the gate connected to the first control node A having a high voltage, the fifth transistor TR5 of the first controller 210 having the gate connected to the first control node A having a high voltage, and the thirteenth transistor TR13 of the second controller 230 having the gate connected to the fourth control node D having a high voltage may be turned on. A first voltage VGH may be transmitted to the first output node N1 through the fifteenth transistor TR15, a clock signal CLK may be transmitted to the second output node N2 through the fifth transistor TR5, and a second voltage VGL1 may be transmitted to the third output node N3 through the thirteenth transistor TR13. Thus, the output unit 250 may output a k-th output signal Out[k] having a high voltage through the first output terminal OUT1, the first controller 210 may output a first carry signal CRA[k] following the waveform (e.g., having a waveform that is the same or substantially the same as that) of the clock signal CLK through the second output terminal OUT2, and the second controller 230 may output a second carry signal CRB[k] having a low voltage through the third output terminal OUT3.

When the first control node A and the third control node C have a high voltage, voltage levels thereof may be boosted by the first capacitor C1 and the third capacitor C3, respectively, and thus, may be higher than the high-level voltages of the second control node B and the fourth control node D when having (e.g., when set to) the high voltage.

In the second period P2, a transistor of a pixel circuit, to which the k-th output signal Out[k] of a high voltage is applied to a gate thereof, may be turned on.

In FIG. 5, a length of the second period P2 is shown as being greater than that of the first period P1. However, the present disclosure is not limited thereto, and the lengths of the first period P1 and the second period P2 may be variously adjusted according to a function performed by a transistor of a pixel circuit that receives the output signal.

Figure 6A:
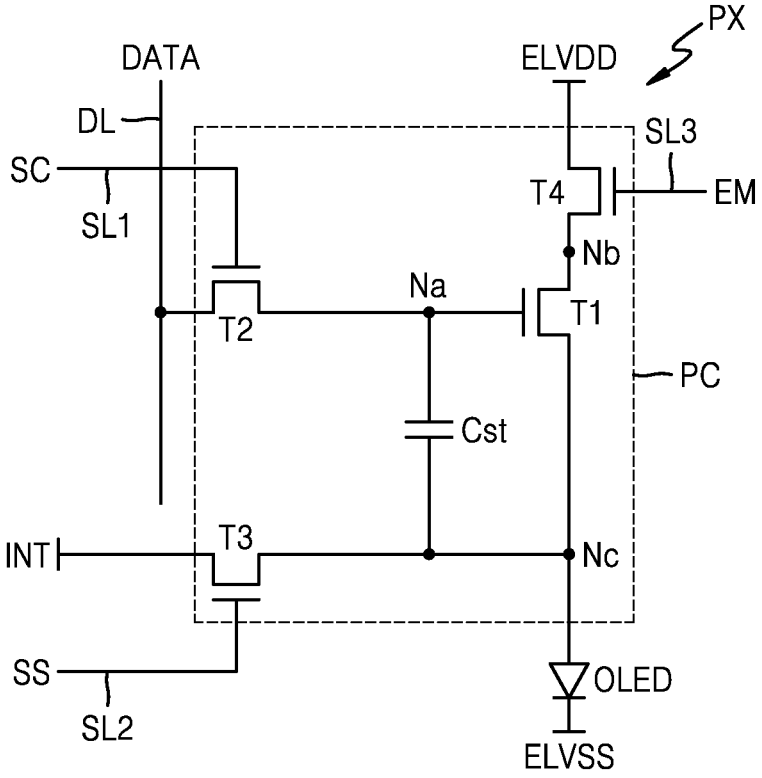
FIG. 6A is an equivalent circuit diagram illustrating a pixel according to an embodiment.
Figure 6B:
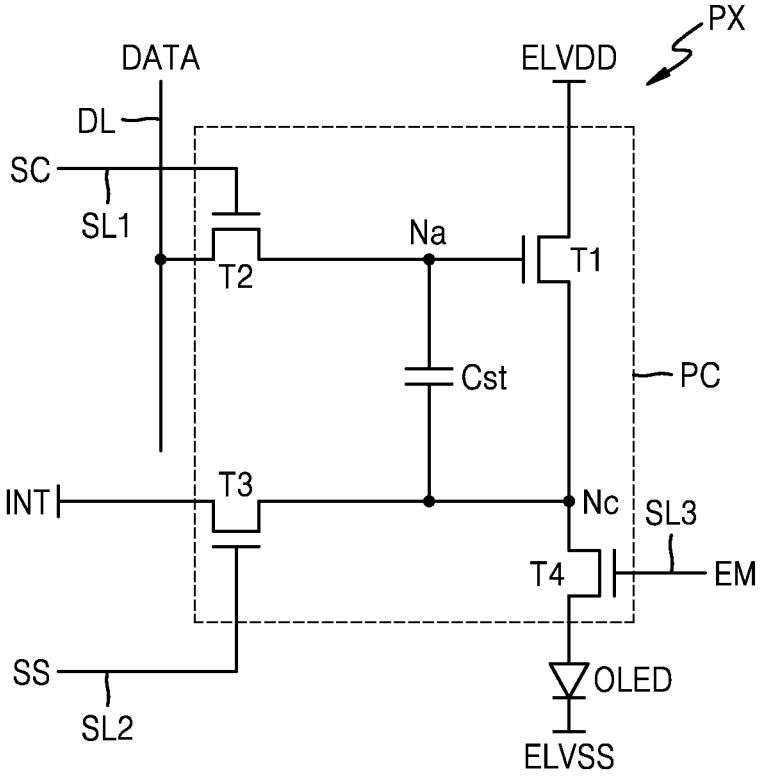
FIG. 6B is an equivalent circuit diagram illustrating a pixel according to an embodiment.

FIGS. 6A and 6B are equivalent circuit diagrams illustrating a pixel according to one or more embodiments.

Referring to FIG. 6A, the pixel PX may include a pixel circuit PC, and an organic light emitting diode OLED as a display element connected to the pixel circuit PC. The pixel circuit PC may include a first transistor T1, a second transistor T2, a third transistor T3, a fourth transistor T4, and a capacitor Cst. The first transistor T1 may be a driving transistor in which a magnitude of a source-drain current is determined according to a gate-source voltage thereof, and the second through fourth transistors T2 through T4 may be switching transistors that are turned on/off according to a gate voltage thereof.

The first transistor T1 may include a gate connected to a first node Na, a first terminal connected to a second node Nb, and a second terminal connected to a third node Nc. The first terminal of the first transistor T1 may be connected to a driving voltage line for supplying a first power supply voltage ELVDD via the fourth transistor T4, and a second terminal of the first transistor T1 may be connected to a first electrode (e.g., a pixel electrode, an anode, and the like) of the organic light emitting diode OLED. The first transistor T1 may function as a driving transistor, and may receive a data signal DATA according to a switching operation of the second transistor T2, to control an amount of a driving current flowing through the organic light emitting diode OLED.

The second transistor T2 (e.g., a data writing transistor) may include a gate connected to a first scan line SL1, a first terminal connected to the data line DL, and a second terminal connected to the first node Na (e.g., to the gate of the first transistor T1). The second transistor T2 may be turned on according to the scan signal SC input through the first scan line SL1, and may electrically connect the data line DL to the first node Na to transmit the data signal DATA input through the data line DL to the first node Na.

The third transistor T3 (e.g., an initialization transistor) may include a gate connected to a second scan line SL2, a first terminal connected to the third node Nc (e.g., to the second terminal of the first transistor T1), and a second terminal connected to an initialization voltage line for supplying an initialization voltage INT. The third transistor T3 may be turned on by a scan signal SS supplied to the second scan line SL2, and may transmit the initialization voltage INT transmitted to the initialization voltage line to the third node Nc.

The fourth transistor T4 (e.g., an emission control transistor) may include a gate connected to a third scan line SL3, a first terminal connected to the driving voltage line, and a second terminal connected to the second node Nb (e.g., to the first terminal of the first transistor T1). The fourth transistor T4 may be turned on according to a scan signal EM transmitted to the third scan line SL3, so that a current may flow through the organic light emitting diode OLED.

The capacitor Cst may be connected between the first node Na and the second terminal of the first transistor T1. The capacitor Cst may store a voltage corresponding to a difference between a voltage transmitted from the second transistor T2 and an electric potential of the second terminal of the first transistor T1.

The organic light emitting diode OLED may include the first electrode connected to the second terminal of the first transistor T1, and a second electrode (e.g., an opposite electrode, a cathode, and the like) to which a second power supply voltage ELVSS as a common voltage is applied. The organic light emitting diode OLED may emit light having a desired brightness (e.g., a predetermined or certain brightness) due to the driving current supplied from the first transistor T1.

In another embodiment, as shown in FIG. 6B, the fourth transistor T4 may be connected between the first transistor T1 and the organic light emitting diode OLED. For example, referring to FIG. 6B, the fourth transistor T4 may include a gate connected to the third scan line SL3, a first terminal connected to the third node Nc, and a second terminal connected to the first electrode of the organic light emitting diode OLED.

In FIGS. 6A and 6B, the first through fourth transistors T1 through T4 of the pixel circuit PC may be N-type transistors. For example, the first through fourth transistors T1 through T4 may be oxide thin film transistors.

In an embodiment, each stage of the scan driver 130 shown in FIG. 2 may be connected to one of the first scan line SL1 connected to the gate of the second transistor T2, the second scan line SL2 connected to the gate of the third transistor T3, and the third scan line SL3 connected to the gate of the fourth transistor T4 of the pixel circuit PC shown in FIGS. 6A and 6B. The output signal output from the first output terminal OUT1 of each stage of the scan driver 130 shown in FIG. 2 may be one of the scan signals SC, SS, and EM applied to the first through third scan lines SL1 through SL3. For example, each stage of the scan driver 130 shown in FIG. 2 may be connected to the third scan line SL3 of the pixel circuit PC shown in FIGS. 6A and 6B of a corresponding pixel PX provided in a corresponding row, and may output an output signal as the scan signal EM to the third scan line SL3. Thus, the scan signal EM may be supplied to the gate of the fourth transistor T4 of the pixel circuit PC.

When the scan signal EM of a high voltage is supplied (e.g., when the stage outputs an output signal of a high voltage), the fourth transistor T4 may be turned on, and the organic light emitting diode OLED may emit light. In other words, the second period P2 of FIG. 5 may be an emission period. When the scan signal EM of a low voltage is supplied (e.g., when the stage outputs an output signal of a low voltage), the fourth transistor T4 may be turned off, and the organic light emitting diode OLED may not emit light. In other words, the first period P1 of FIG. 5 may be a non-emission period. In this case, the second period P2 may be longer than the first period P1.

The pixel circuit PC shown in FIGS. 6A and 6B are illustrative, and thus, the embodiments of the scan driver described above may be applied to various suitable pixel circuits PC including at least one transistor to which at least one scan signal is applied. For example, the pixel circuit PC of the pixel PX may include a first transistor T1, which is a driving transistor, a second transistor T2 for transmitting a data signal, and a fourth transistor T4 for controlling emission of the organic light emitting diode OLED, such that the third transistor T3 may be omitted, or the pixel circuit PC may further include at least one additional transistor for other functions.

According to one or more embodiments of the present disclosure, a scan driver that may output a scan signal stably, and a display device including the same, may be provided. However, the present disclosure is not limited to the above aspects and features, and other aspects and features may be included that do not depart from the spirit and scope of the present disclosure.

Although some embodiments have been described, those skilled in the art will readily appreciate that various modifications are possible in the embodiments without departing from the spirit and scope of the present disclosure. It will be understood that descriptions of features or aspects within each embodiment should typically be considered as available for other similar features or aspects in other embodiments, unless otherwise described. Thus, as would be apparent to one of ordinary skill in the art, features, characteristics, and/or elements described in connection with a particular embodiment may be used singly or in combination with features, characteristics, and/or elements described in connection with other embodiments unless otherwise specifically indicated. Therefore, it is to be understood that the foregoing is illustrative of various example embodiments and is not to be construed as limited to the specific embodiments disclosed herein, and that various modifications to the disclosed embodiments, as well as other example embodiments, are intended to be included within the spirit and scope of the present disclosure as defined in the appended claims, and their equivalents.

What is claimed is:

1. A scan driver comprising a plurality of stages, each of the plurality of stages comprising:

a first controller configured to control voltage levels of a first control node and a second control node in response to a first start signal and a second start signal, and to output a first carry signal;

a second controller configured to control voltage levels of a third control node and a fourth control node in response to the first start signal and the second start signal, and to output a second carry signal; and an output circuit comprising:

a pull-up transistor having a gate connected to the first control node; and a pull-down transistor having a gate connected to the third control node, wherein the output circuit is configured to output a scan signal based on an on voltage output through the pull-up transistor and an off voltage output through the pull-down transistor, and wherein the first controller and the second controller of each of the plurality of stages is configured to output the first carry signal and the second carry signal to a subsequent stage from among the plurality of stages as the first start signal and the second start signal of the subsequent stage to control the voltage levels of the first through fourth control nodes of the subsequent stage.

2. The scan driver of claim 1, wherein each of the plurality of stages comprises a plurality of transistors that are N-channel oxide thin film transistors.

3. The scan driver of claim 1, wherein a circuit of the first controller and a circuit of the second controller are symmetrical to each other relative to a node, the node being connected to a terminal configured to apply an off voltage to the first controller and the second controller.

4. The scan driver of claim 1, wherein the pull-up transistor is connected between a first voltage input terminal and a first output node, the first voltage input terminal being configured to receive a first voltage having an on voltage level, and the first output node being connected to a first output terminal configured to output the scan signal, and wherein the pull-down transistor is connected between a third voltage input terminal and the first output node, the third voltage input terminal being configured to receive a third voltage having an off voltage level.

5. The scan driver of claim 1, wherein the plurality of stages comprises a first stage and one or more rear-end stages, wherein the first start signal applied to the first stage is a first scan start signal, and the second start signal is an inverted signal of the first start signal, and the first start signal and the second start signal applied to each of the rear-end stages that are subsequent to the first stage are the first carry signal and the second carry signal that are output by a corresponding previous stage.

6. A scan driver comprising a plurality of stages, each of the plurality of stages comprising:

a first controller configured to control voltage levels of a first control node and a second control node in response to a first start signal and a second start signal, and to output a first carry signal;

a second controller configured to control voltage levels of a third control node and a fourth control node in response to the first start signal and the second start signal, and to output a second carry signal; and an output circuit comprising:

a pull-up transistor having a gate connected to the first control node; and a pull-down transistor having a gate connected to the third control node, wherein the output circuit is configured to output a scan signal based on an on voltage output through the pull-up transistor and an off voltage output through the pull-down transistor, and wherein the first controller comprises:

a first transistor connected between a first voltage input terminal and the first control node, and having a gate connected to a first input terminal, the first voltage input terminal being configured to receive a first voltage having an on voltage level, and the first input terminal being configured to receive the first start signal;

a second transistor connected between the first voltage input terminal and the second control node, and having a gate connected to a second input terminal configured to receive the second start signal;

a third transistor connected between the first control node and a node, and having a gate connected to the second control node, the node being connected to a second voltage input terminal configured to receive a second voltage having an off voltage level;

a fourth transistor connected between the second control node and the node, and having a gate connected to the first control node;

a fifth transistor connected between a clock terminal and a second output node, and having a gate connected to the first control node, the clock terminal being configured to receive a clock signal, and the second output node being connected to a second output terminal configured to output the first carry signal;

a sixth transistor connected between the second voltage input terminal and the second output node, and having a gate connected to the second control node;

a first capacitor connected between the first control node and the second output node; and a second capacitor connected between the second control node and the second voltage input terminal.

7. The scan driver of claim 6, wherein:

during a first period of a frame, in response to the second start signal being applied as an on voltage in at least a portion of the first period, the second transistor is configured to set the second control node to an on voltage of the first voltage, and the third transistor is configured to set the first control node to an off voltage of the second voltage; and during a second period after the first period, in response to the first start signal being applied as an on voltage in at least a portion of the second period, the first transistor is configured to set the first control node to an on voltage of the first voltage, and the fourth transistor is configured to set the second control node to an off voltage of the second voltage.

8. The scan driver of claim 7, wherein the first controller is configured to output the first carry signal based on the second voltage output through the sixth transistor during the first period, and based on the clock signal output through the fifth transistor during the second period.

9. The scan driver of claim 8, wherein the clock signal output during the second period comprises a plurality of pulses.

10. The scan driver of claim 6, wherein the third transistor comprises a pair of sub-transistors serially connected between the first control node and the node, and wherein the first controller further comprises a seventh transistor connected between the first voltage input terminal and an intermediate node between the pair of sub-transistors.

11. The scan driver of claim 5, wherein the second controller comprises:

an eighth transistor connected between a first voltage input terminal and the third control node, and having a gate connected to a second input terminal, the first voltage input terminal being configured to receive a first voltage having an on voltage level, and the second input terminal being configured to receive the second start signal;

a ninth transistor connected between the first voltage input terminal and the fourth control node, and having a gate connected to a first input terminal configured to receive the first start signal;

a tenth transistor connected between the third control node and a node, and having a gate connected to the fourth control node, the node being connected to a second voltage input terminal configured to receive a second voltage having an off voltage level;

an eleventh transistor connected between the fourth control node and the node, and having a gate connected to the third control node;

a twelfth transistor connected between a clock terminal and a third output node, and having a gate connected to the third control node, the clock terminal being configured to receive a clock signal, and the third output node being connected to a third output terminal configured to output the second carry signal;

a thirteenth transistor connected between the second voltage input terminal and the third output node, and having a gate connected to the fourth control node;

a third capacitor connected between the third control node and the third output node; and a fourth capacitor connected between the fourth control node and the second voltage input terminal.

12. The scan driver of claim 11, wherein:

during a first period of a frame, in response to the second start signal being applied as an on voltage in at least a portion of the first period, the eighth transistor is configured to set the third control node to an on voltage of the first voltage, and the eleventh transistor is configured to set the fourth control node to an off voltage of the second voltage; and during a second period after the first period, in response to the first start signal being applied as an on voltage in at least a portion of the second period, the ninth transistor is configured to set the fourth control node to an on voltage of the first voltage, and the tenth transistor is configured to set the third control node to an off voltage of the second voltage.

13. The scan driver of claim 12, wherein the second controller is configured to output the second carry signal based on the clock signal output through the twelfth transistor during the first period, and based on the second voltage output through the thirteenth transistor during the second period.

14. The scan driver of claim 13, wherein the clock signal output during the first period comprises a plurality of pulses.

15. The scan driver of claim 11, wherein the tenth transistor comprises a pair of sub-transistors serially connected between the third control node and the node, and wherein the second controller further comprises a fourteenth transistor connected between the first voltage input terminal and an intermediate node between the pair of sub-transistors.

16. A display device comprising:

a pixel area comprising a plurality of pixels, the plurality of pixels being connected to scan lines and data lines; and a scan driver configured to output scan signals to the scan lines, wherein the scan driver comprises a plurality of stages, each of the plurality of stages comprising:

a first controller configured to control voltage levels of a first control node and a second control node in response to a first start signal and a second start signal, and to output a first carry signal;

a second controller configured to control voltage levels of a third control node and a fourth control node in response to the first start signal and the second start signal, and to output a second carry signal; and an output circuit comprising:

a pull-up transistor having a gate connected to the first control node; and a pull-down transistor having a gate connected to the third control node, and wherein the output circuit is configured to output a scan signal based on an on voltage output through the pull-up transistor and an off voltage output through the pull-down transistor, and wherein the first controller and the second controller of each of the plurality of stages is configured to output the first carry signal and the second carry signal to a subsequent stage from among the plurality of stages as the first start signal and the second start signal of the subsequent stage to control the voltage levels of the first through fourth control nodes of the subsequent stage.

17. The display device of claim 16, wherein each of the pixels comprises a pixel circuit comprising a plurality of transistors that are N-channel oxide thin film transistors, and each of the stages comprises a plurality of transistors that are N-channel oxide thin film transistors.

18. The display device of claim 16, wherein a circuit of the first controller and a circuit of the second controller are symmetrical to each other relative to a node, the node being connected to a terminal configured to apply an off voltage to the first controller and the second controller.

19. The display device of claim 16, wherein the pull-up transistor is connected between a first voltage input terminal and a first output node, the first voltage input terminal being configured to receive a first voltage having an on voltage level, and the first output node being connected to a first output terminal configured to output the scan signal, and wherein the pull-down transistor is connected between a third voltage input terminal and the first output node, the third voltage input terminal being configured to receive a third voltage having an off voltage level.

20. The display device of claim 16, wherein the plurality of stages comprises a first stage and one or more rear-end stages, wherein the first start signal applied to the first stage is a first scan start signal, and the second start signal is an inverted signal of the first start signal, and wherein the first start signal and the second start signal applied to each of the rear-end stages that are subsequent to the first stage are the first carry signal and the second carry signal that are output by a corresponding previous stage.

* * * * *